United States Patent [19]

Kukuch

[11] Patent Number: 4,934,613

[45] Date of Patent: Jun. 19, 1990

[54] APPARATUS FOR CRUSHING BRITTLE MATERIAL FOR GRINDING

[75] Inventor: Karl-Heinz Kukuch, Ennigerloh, Fed. Rep. of Germany

[73] Assignee: Krupp Polysius AG, Fed. Rep. of Germany

[21] Appl. No.: 366,749

[22] Filed: Jun. 14, 1989

[30] Foreign Application Priority Data

Jul. 5, 1988 [DE] Fed. Rep. of Germany ..... 3822729

[51] Int. Cl.[5] ..... B02C 4/02

[52] U.S. Cl. ..... 241/39; 241/79; 241/152 A; 241/284

[58] Field of Search ..... 241/5, 29, 39, 40, 152 A, 241/152 R, 40, 80, 97, 46.17, 26, 284, 79

[56] References Cited

U.S. PATENT DOCUMENTS 2,679,982 6/1954 Thyle ..... 241/284 X 4,732,334 3/1988 Muller et al. ..... 241/152 A X 4,783,011 11/1988 Blasczy et al. ..... 241/152 A X

*Primary Examiner*—Mark Rosenbaum

*Attorney, Agent, or Firm*—Learman & McCulloch

[57] ABSTRACT

In this apparatus for crushing brittle material for grinding a size reduction device is arranged between a roller mill ( for pressure crushing) and a screen classifier (for classifying the crushed product) for disagglomeration of the crushed product in round and flat form (agglomerates). For energy-saving and reliable disagglomeration of these agglomerates the size reduction device has an inlet section with feed arrangements for agglomerates and fluid as well as turbulence section, so that the agglomerates can be intensively intermixed and at least partially broken up in the first section and completely disagglomerated in the second section, whereupon a feed pump feeds the dissagglomerated crushed product to the screen classifier as a fluid suspension without clogging.

15 Claims, 3 Drawing Sheets

APPARATUS FOR CRUSHING BRITTLE MATERIAL FOR GRINDING

The invention relates to apparatus for crushing brittle material for grinding, especially mineral material, wherein size reduction of agglomerates is accomplished by water injection followed by turbulence treatment.

BACKGROUND OF THE INVENTION

Crushing apparatus of the type mentioned above has already been proposed by the applicants (German Patent Application No. P 37 12 147.2). According to this a size reduction device which can be constructed in the form of a hammer mill, an impact mill, a mixing vessel with fluid supply or in any other suitable manner is arranged in the region between a roller mill and screen classifier in order to reduce the size of the flat round agglomerates (so-called scabs) formed in the pressure crushing before the classifying operation so as to release the fines contained in these agglomerates. Crushing apparatus of this type is particularly suitable for pressure crushing of mineral material for grinding, such as for example cement clinker and ore. This crushing can generally take place in a dry or wet process.

SUMMARY OF THE INVENTION

The object of the invention is to develop apparatus for the crushing of brittle material for grinding particularly in such a way that before the round flat agglomerates formed during the pressure crushing in the roller mill are delivered to the classifier they can be disagglomerated in a relatively simple and extremely effective way to such an extent that substantially the entire quantity of fines in these agglomerates is released before they are delivered to the classifier.

The core of the present invention is constituted by the size reduction device which is arranged between the roller mill and the classifier and is divided into an inlet section with the feed arrangements for the agglomerates and the fluid and a turbulence section at the lower end of which a feed pump is provided for the suspension of fluid and disagglomerated product of the crushing operation. Thus in this crushing apparatus according to the invention at least the disagglomeration of the crushed product, namely the scabs, takes place in a wet process in which first of all a slurry is produced from the product crushed in the roller mill and delivered fluid (especially water) in the inlet section of the size reduction device, and for this purpose the chute-like agglomerate feed arrangement of the inlet section opens into a feed channel to which the fluid feed arrangement is connected in the manner of driven water injector. The aforementioned feed channel delivers the slurry mixture which has been formed to the turbulence section of the size reduction device in which a disagglomerating effect is exerted on the scabs (product of crushing in the roller mill).

In the tests on which the invention is based, it proved particularly advantageous that the crushing operation can be carried out in the roller mill with considerable saving of energy if damp or even wet material for grinding were delivered to the roller mill. During the crushing operation, i.e. during the pressure crushing between the rollers, there was a surprisingly good water-removal effect for the product of the crushing.

Advantageous constructions and further developments of the invention are the subject matter of the subordinate claims.

It should be mentioned at this point that the scabs obtained from the roller mill as the product of crushing can differ in each case as regards hardness depending upon the nature of the material for grinding which is fed in. Accordingly, the measures according to the subordinate claims are particularly good, especially enabling the size reduction device according to the invention to be constructed in such a way that it can be adjusted particularly well to suit the expected hardness of the scabs.

THE DRAWINGS

The invention will be explained in greater detail below with the aid of several embodiments which are illustrated in the drawings. In the drawings, which have been kept largely schematic:

DETAILED DESCRIPTION

Figure 2:
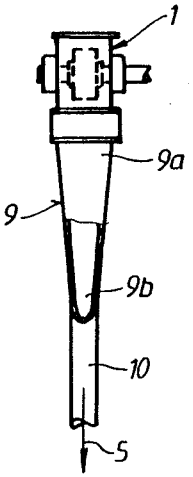
FIG. 2 shows a partial vertical sectional view through the inlet section of the size reduction device, approximately according to the section line II—II in FIG. 1.

First of all the general construction of the first embodiment of the crushing apparatus according to the invention, which is designed for the crushing of brittle material for grinding, such as for example cement clinker, ore, etc. will be described with the aid of FIG. 1.

This crushing apparatus according to FIG. 1 contains as its principal parts a roller mill 1 which is only indicated roughly and is known per se as regards construction, a size reduction device 2 which is arranged approximately in the region below the roller mill and has an inlet section 3 and a turbulence section 4 as well as a screen classifier 6 which is arranged after the breaking device 2 in the direction of movement of the material (cf. arrows 5) which can also be of a construction which is known per se and serves to classify the material delivered at least into a product which falls through (arrow 7) and a retained product (arrow 8). The breaking device 2 serves to disagglomerate or break up the round flat agglomerates of the product of crushing in the roller mill, which are simply referred to hereafter as scabs, to such an extent that in the following screen classifier 6 the quantities of fines contained in the scabs can be separated as thoroughly as possible from the coarse material which can then be returned to the roller mill 1.

Thus the size reduction device 2 is an essential part of the crushing apparatus in the region between the roller mill 1 and the screen classifier 6.

In the first embodiment of the size reduction device which is explained below with the aid of FIGS. 1 to 3 it may be assumed that this device is intended above all for breaking up scabs of relatively low hardness.

This size reduction device 2 is—as already indicated—divided into an inlet section 3 and a turbulence section 4.

Figure 1:
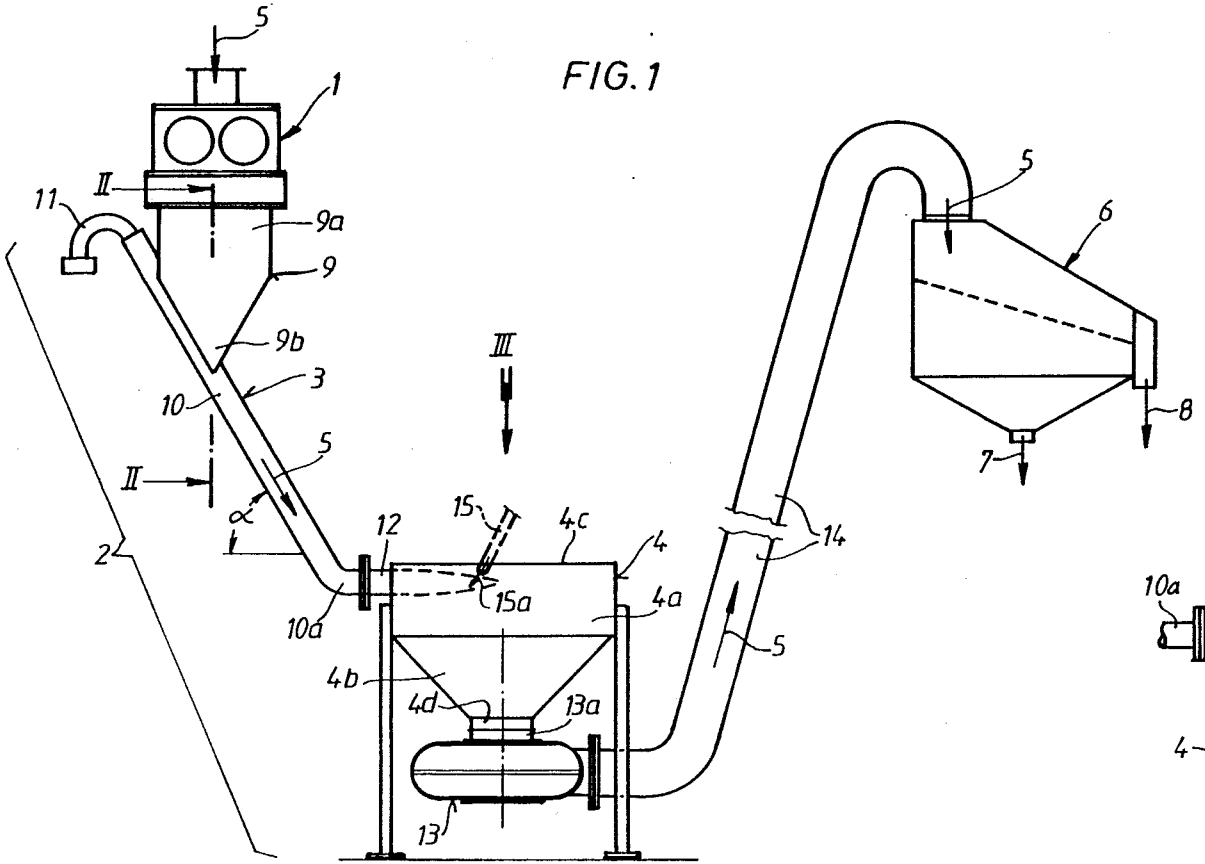
FIG. 1 shows an overall view of a first embodiment of the crushing apparatus in which the turbulence section of the size reduction device is formed essentially by a pump sump.

As FIGS. 1 and 2 show, the inlet section 3 contains an agglomerate feed arrangement 9 which is of chute-like construction like a hopper. In this example it is preferred for the upper end 9*a* of the agglomerate feed arrangement 9 to be arranged immediately below the outlet of the roller mill 1. Accordingly the cross-sectional dimensions of this upper end 9*a* of the feed arrangement are kept sufficiently large for the scabs resulting from the pressure crushing in the roller mill 1 to be able to fall directly into this feed arrangement 9; in cross-section, as shown in FIG. 2, this feed arrangement 9 can have a tall and narrow funnel shape.

The lower end 9*b* of the agglomerate feed arrangement 9 opens into a feed channel 10 which can be constructed like a mixing tube and is connected to the fluid feed arrangement 11 in the manner of a driven water injector which is known per se. This tubular feed channel 10 runs from the lower end 9*b* of the agglomerate feed arrangement 9 to the region of the inlet 12 of the turbulence section 4 at an acute angle $\alpha$ with respect to the horizontal. This inclination of the feed channel 10 can be adapted to the nature (particularly the bulk weight) of the material to be disagglomerated and be approximately in the range between 30° and 75°; in the example of FIG. 1 the angle of inclination $\alpha$ is approximately 60°. The lower end of the feed channel 10 is preferably constructed with a pipe bend 10*a* which can be flanged onto the inlet 12 of the turbulence section 4 or fastened thereon in some other way.

The turbulence section 4 of this first example is essentially formed by a pump sump which has a substantially cylindrical upper part 4*a* and a lower part 4*b* which tapers downwards like a funnel. The cylindrical upper part 4*a* of this turbulence section 4 has an inlet 12 which—as shown in FIG. 3—is constructed in the form of a pipe and is connected tangentially to this upper part 4*a*—right below its top wall 4*c*. The outlet opening 4*d* of the turbulence section 4 is open towards the bottom and is located on the lower end of the funnel-shaped lower part 4*b*. The inlet aperture 13*a* of a feed pump 13, by means of which the suspension of fluid and disagglomerated crushing product (scabs) is delivered directly to the screen classifier 6 via a suspension feed pipe 14, is connected directly to the lower outlet opening 4*d*. In the present case the suspension feed pump is constructed as a vertical pump 13 with an upper inlet aperture 13*a*. As a result of this construction and coordination of the pump sump and the feed pump the suspension of fluid and disagglomerated scabs can flow quite freely, i.e. without any deposits or clogging, out of the lower part 4*b* of the turbulence section 4 directly to the feed pump 13; a further pump to transport the suspension to the screen classifier 6 is not necessary.

With regard to the way in which this size reduction device 2 functions attention is directed to the following: In the agglomerate feed arrangement 9 the scabs coming from the roller mill 1 fall downwards directly into the feed channel 10. Here the stream of water which is delivered as though injected by the fluid feed arrangement 11 strikes the scabs which are delivered and thus—simultaneously with intensive intermixing—causes a first breaking up or disagglomeration of the scabs. This results in turbulence, and the scabs are transported downwards at an angle in the feed channel 10 together with the stream of water, deflected approximately horizontally and then washed tangentially via the inlet 12 into the upper part 4*a* of the turbulence section 4 which is constructed in the form of a pump sump. In this turbulence section the stream of suspension moves helically downwards with a sufficient residence time for the scabs to undergo further disagglomeration here. Then finally the scabs which are sufficiently disagglomerated pass—suspended in the water—via the lower outlet opening 4*d* of the turbulence section 4 directly into the suspension feed pump 13 which conveys this suspension via the suspension feed pipe 14 to the screen classifier 6.

Figure 3:
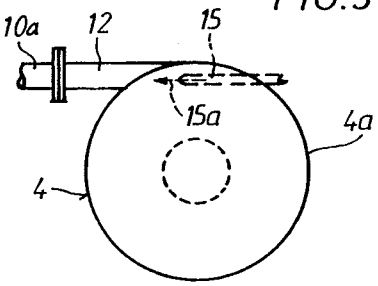
FIG. 3 shows a plan view—according to the arrow III in FIG. 1—of the turbulence section of this first embodiment.

As is indicated by broken lines in FIGS. 1 and 3, it can be particularly advantageous for a water-jet nozzle 15 directed at an angle against the region of the tangential inlet 12 of the turbulence section 4 to be provided in the upper part 4*a* of the turbulence section 4, and preferably on the top wall 4*c* thereof. This additional water-jet nozzle proves very advantageous to the extent that with the aid of the water jet 15*a* a lateral influence can be exerted on the suspension stream, which is introduced tangentially and moves downwards approximately helically, in such a way that an additional turbulence of this suspension stream and thus a further increased disagglomeration of the scabs can be produced.

A second example of the construction of a size reduction device arranged between the roller mill and the screen classifier will be explained with the aid of FIGS. 4 and 5. The roller mill for the pressure crushing of the brittle material for grinding and the screen classifier can in general be constructed and arranged in the same way as in the first embodiment, and therefore the roller mill and the screen classifier have been omitted in FIG. 4 for the sake of greater clarity, i.e. FIG. 4 essentially shows only this second embodiment of the size reduction device 2'. This second embodiment is particularly suitable for scabs of medium and great hardness.

In this second embodiment too the size reduction device 2' is again divided into an inlet section 3' and a turbulence section 16.

The inlet section 3' of this second embodiment can be of exactly the same construction as the inlet section 3 of the first example, so that essentially a detailed description of the inlet section 3' can be omitted. It will merely be pointed out that this inlet section 3' again contains a chute-like agglomerate feed arrangement 9' which opens into the tubular feed channel 10', and again the fluid feed arrangement 11' is connected to the feed channel 10'—as indicated—in the manner of a driven water injector. In this case the feed channel 10' which goes out from the lower end of the chute-like agglomerate feed arrangement 9' then runs as far as the upper inclined inlet 17 of the turbulence section 16 at an acute angle $\alpha$ with respect to the horizontal.

As regards the arrangement of the roller mill which is not shown in greater detail in FIG. 4, this can be the same as in the first example, i.e. the upper end of the agglomerate feed arrangement 9' can also be arranged immediately below the outlet of the roller mill. It should also be mentioned at this point that it is basically also possible, both in this example and in the preceding one, for the roller mill to be arranged offset with respect to the agglomerate feed arrangement 9 or 9', in which case a suitable intermediate conveyor is to be provided.

As regards the construction of the turbulence section 16 of this second embodiment (FIGS. 4 and 5), this turbulence section can generally contain at least one turbulence stage in the form of an upright turbulence chamber. In the embodiment illustrated in FIG. 4 it may be assumed that this turbulence section 16 contains two turbulence stages, each of which is formed by an essentially similar turbulence chamber, namely an upper turbulence chamber 18 and a lower turbulence chamber 19. These two turbulence chambers 18, 19 are arranged below one another in a staggered or stepped formation, in a manner which will be explained below.

Since all the turbulence chambers 18, 19 can be of similar construction it is sufficient merely to provide a detailed description of one of these chambers, for example the chamber 18. Such a turbulence chamber 18 has a substantially vertical outer container 20 which can basically be of any suitable cross-sectional shape, but preferably has a rectangular, particularly square cross-section according to FIG. 5. The inlet 17 is fixed substantially flush on one side wall 20*a* of this chamber container 20, i.e. directly on the side surface, as indicated by dash-dot lines in FIG. 5. A vertical agitator shaft 22 connected approximately centrally to a rotary drive 21 is arranged in this container 20, which is square in cross-section, of the turbulence chamber 18 and extends over substantially the entire height in the chamber housing 20. In the lower region a substantially horizontal screen base 23, which extends over the entire container cross-section and is constructed in the form of a stable screen or grid with appropriate width of opening, is mounted in the turbulence chamber 18 or the chamber housing 20. The vertical agitator shaft 22 extends downwards through the screen base 23, at least one agitator being supported by the agitator shaft 22 in each case above and below the screen base 23. It has proved advantageous for the practical construction for an agitator 24 to be provided at a suitable distance below the screen base 23, while above the screen base 23 at least two—as in the present case—agitators 25, 26 are fixed on the agitator shaft 22 so that they are axially spaced from one another and from the screen base 23.

Figures 4, 5:
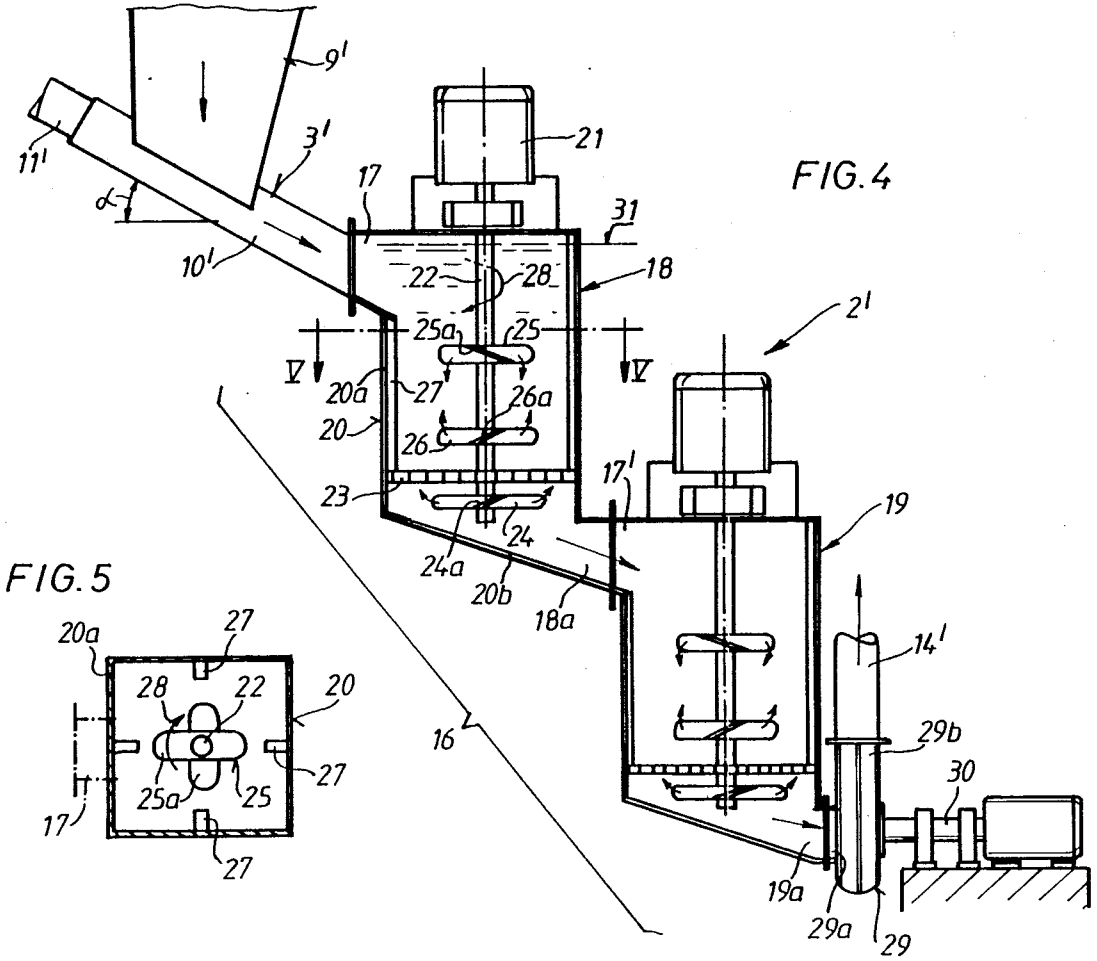
FIG. 4 shows a view in particular of a second embodiment of the size reduction device in which the turbulence section is formed by two turbulence chambers which are arranged staggered one below the other.
FIG. 5 shows a cross-sectional view along the line V—V in FIG. 4 through a turbulence chamber.

As is indicated in FIG. 4 (and to some extent also in FIG. 5), each agitator 24, 25, 26 has a plurality of agitator elements 24*a*, 25*a*, 26*a*, the agitator elements of the different agitators being mounted at different setting angles with respect to the horizontal. In the case of the two agitators 25, 26 arranged on the agitator shaft 22 above the screen base 23 it is provided that the agitator elements 25*a*, 26*a* are set so that the upper agitator 25 produces a fluid flow which is directed strongly downwards and the lower agitator produces a fluid flow which is directed only slightly upwards (as indicated in each case by arrows), whereas the agitator elements 24*a* of the agitator 24 mounted on the stirrer shaft 22 below the screen base 23 are set to produce a fluid flow which is directed upwards relatively strongly.

As can be seen in particular in FIG. 5, a plurality of strips which are aligned approximately vertically, so-called rebound strips 27, can be mounted at least on the inner wall of the container 20 of the upper turbulence chamber 18 and are evenly distributed over the inner periphery of the turbulence chamber 18. According to the cross-sectional representation in FIG. 5 a vertical rebound strip 27 is provided approximately in the centre of each of the four side walls of the container 20. It may further be assumed that the agitator shaft 22 is driven in the rotary direction of the arrow 28.

Below the screen base 23 and the agitator 24 which is arranged below it on the agitator shaft 22, the turbulence chamber 18 or its container 20 preferably has a chamber base or container base 206 which is preferably inclined on one side and on which an outlet which is preferably constructed in the form of a lateral outlet 18*a* for the suspension of disagglomerated scabs and fluid is constructed. Thus the lateral outlet 18*a* runs downwards at an angle from the lower end of the turbulence chamber 18 and is connected directly to the inlet 17' of the second turbulence chamber 19 arranged after the first turbulence chamber 18.

As has already been mentioned above and as can be seen clearly in FIG. 4, the two turbulence chambers 18, 19 in this example are arranged in step formation immediately behind and below one another in such a way that the lower suspension outlet 18*a* from the first turbulence chamber 18 is directly connected to the inlet 17' of the second turbulence chamber 19, the inlet 17 of the first turbulence chamber 18 forms the inlet for the turbulence section 16 provided here, and the suspension outlet of the second turbulence chamber 19, which is also constructed as a lateral outlet 19*a*, forms the suspension outlet of the entire turbulence section 16.

The intake 29*a* of the suspension feed pump 29 provided here is connected directly to this suspension outlet or lateral suspension outlet 19*a*, whilst the pressure connection 29*b* of this feed pump 29 is connected to the suspension feed pipe 14' which in turn is connected to the screen classifier which is not shown in FIG. 4.

It goes without saying that in the embodiment of the turbulence chamber 16 according to FIG. 4 the number of turbulence stages formed by turbulence chambers, e.g. 18, 19, can be adapted to the prevailing requirements, i.e. in the case of scabs of limited hardness one single turbulence chamber, e.g. 18, can be sufficient, whereas for particularly hard scabs more than two vertical turbulence chambers of substantially similar design can be arranged in step formation one below the other. If at least two such turbulence chambers, i.e. for example the turbulence chambers 18 and 19, are arranged in step formation behind and below one another, then it is particularly advantageous if the screen base 23 of the succeeding turbulence chamber in the flow direction, e.g. 19, has a smaller mesh size (screen holes) than the screen base 23 of the preceding turbulence chamber, e.g. 18.

With regard to the function of this second embodiment of the size reduction device 2' which was described above particularly with the aid of FIG. 4 the following should be said: the preliminary mixing and first crushing or breaking up of the scabs delivered from the roller mill takes place in the same way as in the first embodiment in the similarly constructed inlet section 3'. From here the suspension which is formed is washed downwards into the first, upper turbulence chamber 18 of the turbulence section 16. The agitators 24, 25, 26 which rotate with the agitator shaft 22 produce an extremely intensive turbulence and considerable disagglomeration of the scabs which have been introduced. The intensity of the agitators can be influenced if required by the magnitude of the setting angles of their agitator elements 24*a*, 25*a*, 26*a* and by the number of these agitator elements. The disagglomeration in this turbulence chamber 18 is also aided by the arrangement and distribution of the rebound strips 27 on the inner periphery of the chamber container 20. After sufficient crushing of the scabs they leave the first turbulence chamber 18—suspended in the fluid—through the lateral outlet 18*a* thereof and enter the second turbulence chamber 19 in which a disagglomerating effect is exerted on these scabs in substantially the same way as in the first turbulence chamber 18. The scabs which have been sufficiently crushed and broken up leave this second turbulence chamber 19, which is equipped with a screen base with a smaller mesh size, via the lateral suspension outlet 19*a* through which the suspension passes directly into the suspension feed pump 29 which in this case is preferably constructed with a horizontal drive shaft. In this case too it is possible to operate extremely reliably and without clogging so that the disagglomerated scabs can then be passed directly to the screen classifier. A slurry state or suspension state is preferably maintained in this turbulence section 16, as indicated at 31 in FIG. 4, i.e. this slurry state extends essentially from the lateral outlet 19*a* of the lower turbulence chamber 19 over almost the entire height of the upper turbulence chamber 18.

If the embodiments which are illustrated in particular in FIGS. 1 and 4 are compared briefly with one another, then it can be established that for scabs of relatively low hardness a turbulence section 4 can be constructed in the form of a relatively simple pump sump and—apart from the feed pump itself—without any moving or driven components, whereas for the disagglomeration of scabs of medium and great hardness it is necessary to provide driven agitators and associated screen bases in addition to the fluid turbulence, and here too a series of measures for influencing the intensity of the disagglomeration are given.

Figure 6:
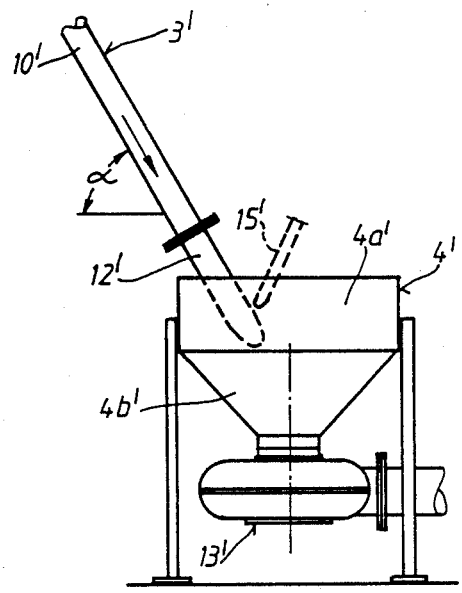
FIG. 6 shows a variant of certain portions of the embodiment of FIGS. 1–3.

Whereas in the first embodiment described above in particular with the aid of FIGS. 1 and 3 the tubular tangential inlet 12 on the cylindrical upper part 4*a* of the turbulence section 4 is aligned approximately horizontally, as also shown in FIG. 4, it can also be particularly advantageous for certain applications of this apparatus if the tubular tangential inlet 12' deviates from the horizontal alignment and, as shown in FIG. 6, opens into the cylindrical upper part 4*a'* of the turbulence chamber 4'.

As can be seen in FIG. 6, the tangential inlet 12' of this variant is initially of tubular construction—just as in the first example—so as to be adapted to the feed channel 10' of the inlet section 3'. This tangential inlet 12', which is inclined upwards for instance as an extension of the feed channel 10', can open into this upper part 4*a'* of the turbulence section 4'. The entire turbulence section 4' with the cylindrical upper part 4*a'* and funnel-shaped lower part 4*b'* as well as the feed pump 13' connected to the lower part 4*b'* can be constructed in practically the same form as has been described above with the aid of FIGS. 1 to 3.

By comparison with the first example (FIGS. 1 to 3), there is no additional pipe bend (10*a*) arranged on the lower end of the feed channel 10' in this variant (FIG. 6), but the feed channel 10' which extends in a straight line is flanged directly on the upper end of the similarly inclined inlet 12'.

This variant of the embodiment described above with the aid of FIG. 6 has the advantage that with particularly heavy material for grinding, i.e. with relatively high bulk weight, it is ensured particularly reliably that no quantities of material for grinding can be deposited in the region of the lower end of the feed channel 10' and/or in the inlet 12'. In this way the mixture of fluid and crushing product (agglomerates or scabs) is introduced without clogging and without delay directly into the turbulence chamber 4 for complete breaking up of the agglomerates.

What is claimed is:

1. In apparatus for crushing brittle material for subsequent grinding having a roller mill in which said material is crushed using high pressure and approximately round and flat agglomerates are formed, a classifier for classification of the product of crushing in the roller mill, and a size reduction device arranged between the roller mill and the classifier having a fluid feed and in which the agglomerates from the roller mill are intermixed with fluid and disagglomerated, the improvement wherein said size reduction device is divided into an inlet section including feed arrangements for the agglomerates and the fluid and a turbulence section having at its lower end a feed pump to receive the intermixture of fluid and disagglomerated crushed product, said agglomerate feed arrangement of said inlet section comprising a chute opening into a feed channel to which said fluid feed arrangement is connected to provide a driven water injector which connects said inlet section to the inlet of said turbulence section.

2. Apparatus as claimed in claim 1, characterized in that the feed channel runs at an acute angle with respect to the horizontal approximately from the lower end of the chute agglomerate feed arrangement to the region of the inlet of the turbulence section.

3. Apparatus as claimed in claim 2, characterized in that the turbulence section is formed essentially by a pump sump which has an approximately cylindrical upper part with a tangential inlet and a funnel-shaped lower part which is tapered downwards and has the inlet aperture of the feed pump connected to its lower outlet opening.

4. Apparatus as claimed in claim 3, characterized in that the feed pump which is connected to the lower outlet opening of the turbulence section is constructed as a vertical pump with an upper inlet aperture and is connected to the classifier via a suspension feed pipe.

5. Apparatus as claimed in claim 3, characterized in that a water-jet nozzle which is directed at an angle from above against the tangential inlet is provided in the upper part of the turbulence section.

6. Apparatus as claimed in claim 3, characterized in that the tangential inlet on the cylindrical upper part of the turbulence section is of tubular construction and is arranged relative to the feed channel to extend approximately horizontally.

7. Apparatus as claimed in claim 3, characterized in that the tangential inlet on the cylindrical upper part of the turbulence section is of tubular construction and is arranged relative to the feed channel at an angle from above to constitute an extension of the feed channel.

8. Apparatus as claimed in claim 2, characterized in that the turbulence section contains at least one turbulence stage in the form of a vertical turbulence chamber in the lower region of which a substantially horizontal screen base is mounted and in which a vertical agitator shaft connected to a rotary drive is arranged approximately centrally so that it extends downwards through the screen base and bears at least one agitator both above and below said screen base.

9. Apparatus as claimed in claim 7, characterized in that the turbulence chamber has a rectangular, preferably square cross-section.

10. Apparatus as claimed in claim 7, characterized in that a plurality of approximately vertically aligned strips which are evenly distributed over the inner periphery of the chamber are mounted on the inner wall of the turbulence chamber.

11. Apparatus as claimed in claim 8, characterized in that above the screen base the agitator shaft has at least two agitators which are mounted an axial distance apart, the agitator elements of which are set so that the upper agitator produces a downwardly-directed fluid flow and the lower agitator produces an upwardly-directed fluid flow, and the agitator elements of the agitator mounted on the agitator shaft below the screen base are also set so as to produce an upwardly-directed fluid flow.

12. Apparatus as claimed in claim 11, characterized in that at least two turbulence stages formed by two turbulence chambers arranged in step formation one below the other are provided in such a way that the lower suspension outlet from the first turbulence chamber is connected directly to the inlet of the second turbulence chamber, and the screen base of a subsequent turbulence chamber in the flow direction in each case has a smaller mesh size than the preceding chamber.

13. Apparatus as claimed in claim 12, characterized in that the suspension outlet of each turbulence chamber is constructed as a lateral outlet on a chamber base which is inclined on one side, and the feed pump with its drive shaft is aligned horizontally so that the lateral suspension outlet of the last turbulence chamber is connected directly to the intake of the feed pump and the pressure connection of the feed pump is connected to the classifier via a suspension feed pipe.

14. Apparatus as claimed in claim 2 characterized in that said acute angle is between 30° and 75°.

15. Apparatus as claimed in claim 1, characterized in that the upper end of the agglomerate feed arrangement is arranged immediately below the outlet of the roller mill.

* * * * *

UNITED STATES PATENT AND TRADEMARK OFFICE

CERTIFICATE OF CORRECTION

PATENT NO. : 4,934,613

DATED : June 19, 1990

INVENTOR(S) : Karl-Heinz Kukuck

It is certified that error appears in the above-identified patent and that said Letters Patent is hereby corrected as shown below:

On the title page, under item [19] and in item [75]:
The inventor's surname should be -- Kukuck -- and not "Kukuch";

In the Abstract, line 9, before "turbulence" insert -- a --;

Column 6, line 4, change "206" to -- 20b --.

Signed and Sealed this

Fifteenth Day of October, 1991

*Attest:*

HARRY F. MANBECK, JR.

*Attesting Officer*

*Commissioner of Patents and Trademarks*